United States Patent [19]

Wameling

[11] 4,096,818

[45] Jun. 27, 1978

[54] DROGUE TYPE DECELERATION DEVICE

[75] Inventor: Richard F. Wameling, Crofton, Md.

[73] Assignee: The United States of America as represented by the Secretary of the Navy, Washington, D.C.

[21] Appl. No.: 800,110

[22] Filed: May 24, 1977

[51] Int. Cl.[2] ..... B63B 21/48

[52] U.S. Cl. ..... 114/311; 114/244

[58] Field of Search ..... 9/8 R, 9; 102/13, 14; 340/2; 114/244, 245, 311; 244/138 R, 138 A

[56] References Cited

U.S. PATENT DOCUMENTS

| | | | |
|---|---|---|---|
| 2,398,794 | 4/1946 | Maltby | 102/13 |
| 3,047,259 | 7/1962 | Tatnall et al. | 244/138 A |
| 3,114,315 | 12/1963 | Trump | 244/138 R X |
| 3,755,836 | 9/1973 | Milazzo | 114/311 |
| 3,978,790 | 9/1976 | Sandelius | 244/138 A X |

*Primary Examiner*—Trygve M. Blix
*Assistant Examiner*—Sherman D. Basinger
*Attorney, Agent, or Firm*—R. S. Sciascia; L. I. Shrago; C. E. Vautrain, Jr.

[57] ABSTRACT

A device for rapidly decelerating a high velocity projectile in a liquid medium, e.g. water, while preventing both excessive high inertial loading of sensitive projectile components and high impact loading of the device itself is provided. A plurality of deployment panels are released at a selected depth and initially opened by leaf springs and thereafter by water flow. Acceleration of the panels is controlled by a piston actuated by the panels which displaces water in a chamber in the drogue body through a suitable orifice.

10 Claims, 6 Drawing Figures

DROGUE TYPE DECELERATION DEVICE

This invention concerns means for decelerating high velocity projectiles in a liquid medium and, more particularly, a device for absorbing the kinetic energy of the projectile within a selected distance and without damaging the projectile and its components.

Many drogue-type deceleration devices have been developed primarily for use as sea anchors by ships. Some of these devices are collapsible so as to be easily stowed aboard ship, and most of the devices open in the manner of an umbrella so as to deploy a canvas canopy strung between rigid struts which develops the hydrodynamic drag. In the mechanisms used in the deployment of these devices, none are known which can achieve a selected deceleration within a restricted distance. Specifically, there is no available device which is capable of selectively decelerating a low drag projectile having high positive buoyancy and a specifically contoured streamlined body shape. Since such a projectile may not be allowed to ascend out of the water because serious structural damage would result upon re-entry, a deceleration device is required which rapidly yet safely reduces projectile velocity as the projectile approaches the surface. The present invention provides such a device.

Accordingly, it is an object of the present invention to provide a deceleration device capable of decelerating a high velocity projectile in a liquid medium within a selected short distance.

Another object of this invention is to provide a device for rapidly decelerating a projectile in a liquid medium in a selected short distance in a manner such that damage to sensitive components by excessively high inertial loading is avoided.

A further object of this invention is to provide a compact means for rapidly but safely decelerating a high velocity projectile in a liquid medium which means is adjustable to open very rapidly and sustain very high loading without structural failure.

Other objects, advantages and novel features of the invention will become apparent from the following detailed description thereof when considered in conjunction with the accompanying drawings in which like numerals represent like parts throughout and wherein.

The present invention, in general, concerns a deceleration device that reduces the velocity of a projectile in water to substantially 0 in less than 100 ft of travel in order to permit the projectile to rapidly approach the surface and yet prevent it from rising out of the water. The device preferably forms an integral part of the projectile tail and includes at least 4 panels contoured to and hinged to the projectile main body shell and connected to a common viscous damping means. In the inoperative condition, the panels are retracted and biased outward preferably by leaf springs and are restrained from deployment by a pressure actuated latching arrangement. The panels are released during ascent at a selected pressure and are rotated outward rapidly by water flow after being initially opened by the springs. Acceleration of the opening panels is controlled by a piston whose motion is regulated by the release of entrapped water through a selectively sized orifice.

Figure 1:
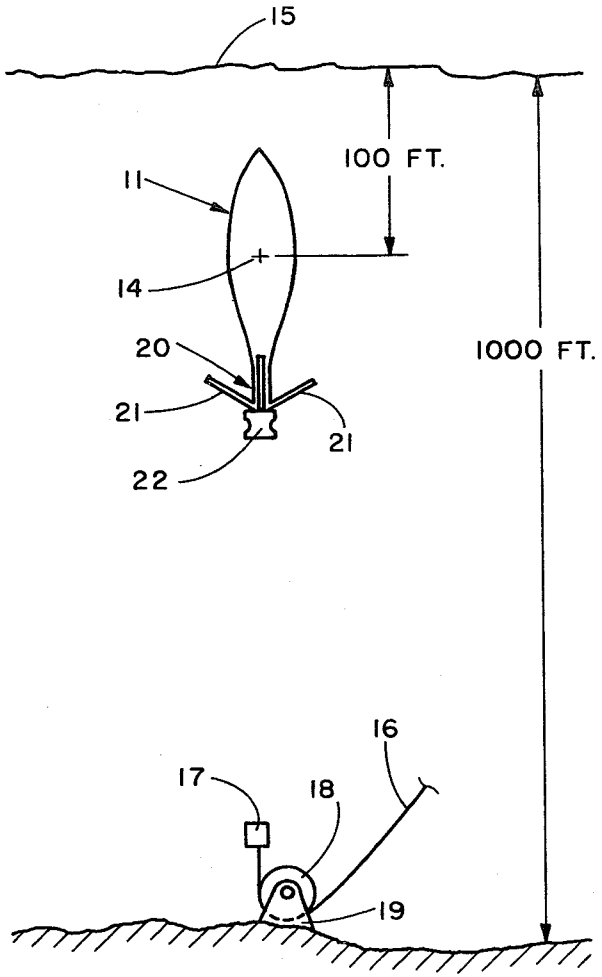
FIG. 1 is a schematic diagram illustrating the conditions under which the deceleration device of the present invention is required to operate.

Referring to the drawings, FIG. 1 is a schematic presentation of the conditions under which a test projectile 11 is to be accelerated from a release position which is substantially at a depth of 1,000 ft to a position where the center of buoyancy of the projectile indicated at 14 is substantially 100 ft from the surface of a body of water 15. Projectile 11 in this case is a test vehicle and is brought to the release position by means of a line 16 which passes over a pulley 17 and is attached to a coupling 18 that is secured by a bracket 19 to the bottom of the body of water. The drogue deceleration device is indicated at 20 and preferably is an integral part of the tail of projectile 11. Drogue 20 includes a plurality of panels 21, which are shown in the deployed position in FIG. 1, and a pulldown coupling 22.

Figure 2:
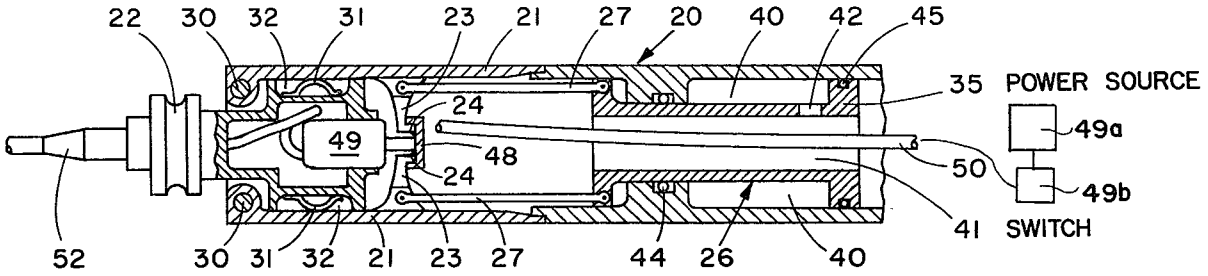
FIG. 2 is a sectional view of the deceleration device in the retracted position.
Figure 3:
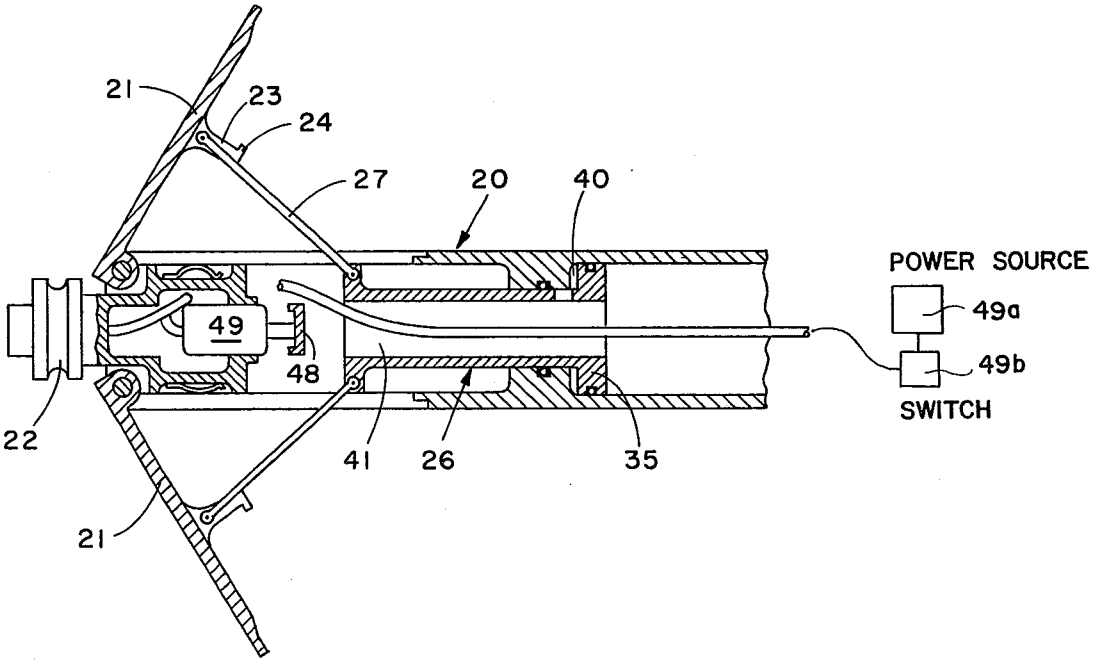
FIG. 3 is a sectional view of the deceleration device in the deployed position.

FIGS. 2 and 3 are sectional views of drogue 20 in the retracted and deployed conditions, respectively. Panels 21 in the retracted position are held in place by respective latches 23 having hooks 24 and are pivotably joined to a piston 26 by respective connecting links 27. Panels 21 are configured to conform to the shape of projectile 11 which in this embodiment is cylindrical and are hinged to the main body shell of the projectile as indicated at 30. In the retracted condition, panels 21 are biased outward under a selective force created in respective leaf springs 31 which are confined in recesses 32 in the projectile body. Piston 26 is provided with a head 35 which is disposed in a chamber 40, with piston 26 having a hollow central passage 41 which is filled by ambient water and which admits water into communicating portions of the drogue. A slot 42 provides communication between chamber 40 and passage 41, with chamber 40 otherwise sealed from ambient conditions by O-rings 44 and 45. The panels are secured in the retracted position by a catch 48 which is operated by a solenoid 49 that is energized at a selected depth by a power source **49*a*** and *a* pressure actuated switch **49*b* in the projectile body, via cable 50. Coupling 22 is remotely actuated by electrical signal via a removable cable 52**.

Figure 4:
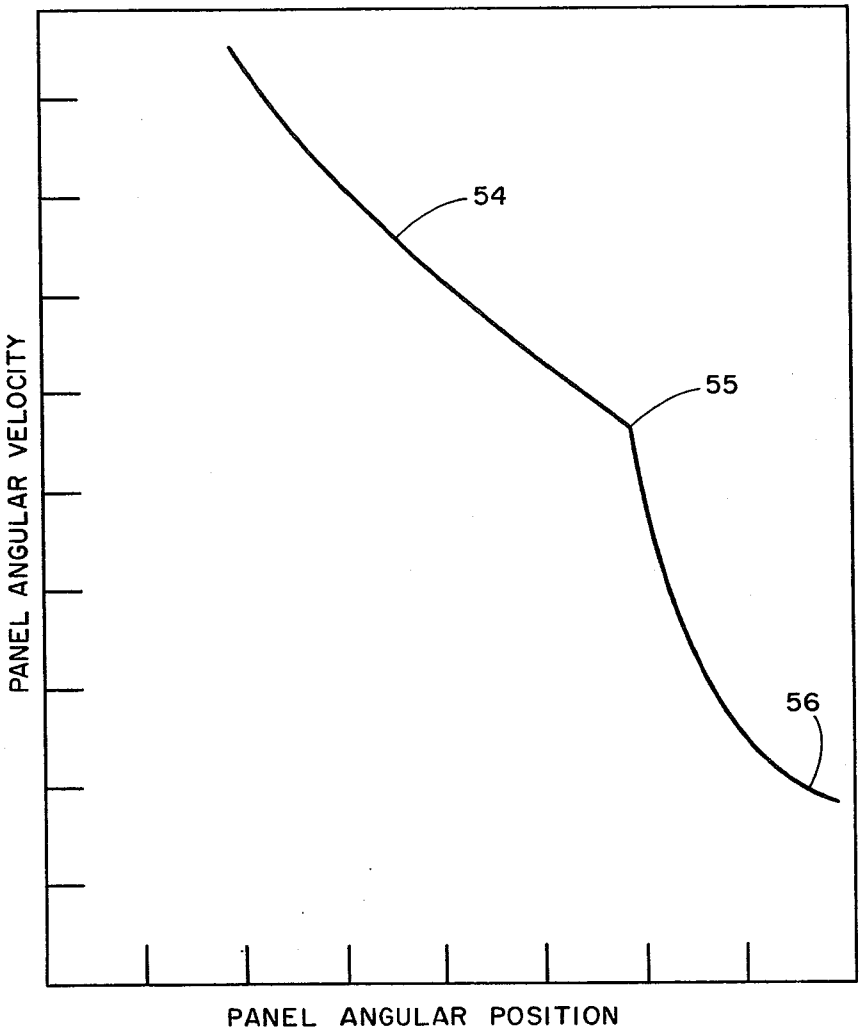
FIG. 4 is a graph illustrating the kinematic relationship between the angular position and the angular velocity of the damped panels in the device.

The graph of FIG. 4 illustrates the relationship between panel position and panel angular velocity for a given orifice size. The curve shows essentially a linear relationship during the initial stages of opening as indicated at 54, an abrupt change at 55 when damping becomes fully effective, and a much reduced angular velocity as the panels approach the extreme open position as indicated at 56.

Figure 6:
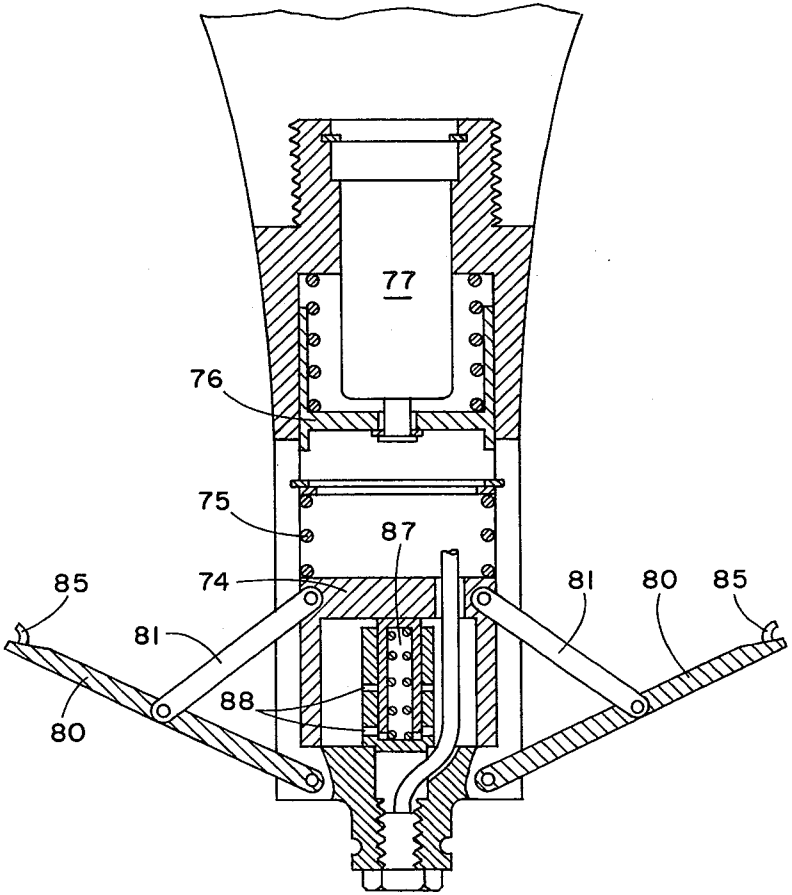
FIG. 6 is a sectional view of a further embodiment of the invention.
Figure 5:
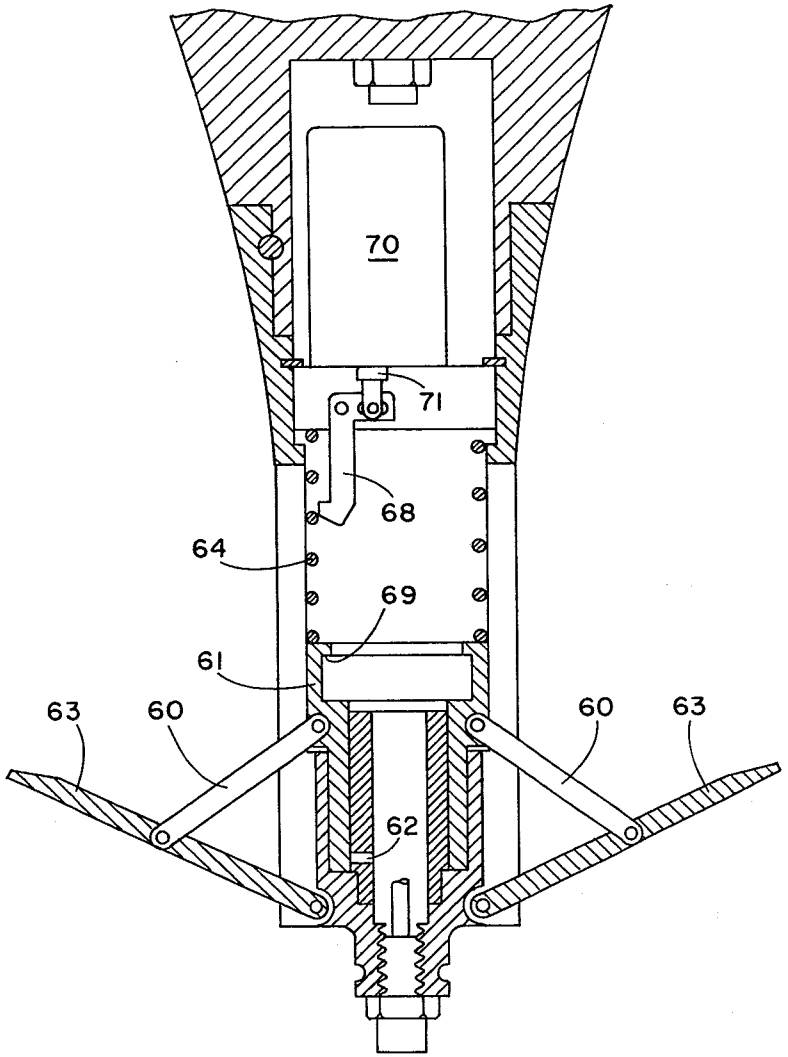
FIG. 5 is a sectional view of an alternate embodiment of the invention.

FIGS. 5 and 6 show alternate embodiments of the invention, with the embodiment of FIG. 5 having connecting links 60 pivotably joined to a piston 61 and damping being effected by release of water through an orifice 62. Retracted, a plurality of panels 63 are force biased outward by a spring 64 which pushes axially on piston 61 which transmits the spring force to the panels through connecting links 60. The panels are restrained from outward motion by a latch 68 which engages a lip 69 on piston 61. When the pressure switch trips causing a solenoid 70 to become energized, solenoid plunger 71 retracts causing latch 68 to rotate slightly thereby releasing piston 61. Spring 64 then, pushing on the piston, starts the piston moving which in turn pushes open the panels via connecting link 60. Once the panels have opened a few degrees, water flow provides the force to open them completely. Water force on the panels tries to open the panels very rapidly but panel motion is resisted and controlled by hydraulic pressure on the piston face as it forces entrapped water through orifice 62. In FIG. 6, a piston 74 is spring loaded in the retracted condition by an actuating spring 75 and released by a release catch 76 operated by a release solenoid 77.

From the retracted position, a plurality of panels 80 are force biased outward by spring 75 which pushes axially on piston 74 which, in turn, transmits the spring bias force to the panels through associated connecting links 81. The panels are restrained from outward motion by the engagement of a lip 85 thereon with catch 76. When the pressure switch trips causing solenoid 77 to become energized, the solenoid plunger retracts causing catch 76 to also retract thereby breaking contact with lip 85. Spring 75 then pushes piston 74 which starts panels 80 outward via links 81. Once the panels have opened a few degrees, water flow provides the force to open them completely. The hydrodynamic force on the panels tries to open the panels very rapidly but panel motion is resisted and controlled by hydraulic pressure developed in a cylinder 87 in piston 74 as the piston forces entrapped water out through a plurality of control orifices 88. The control orifices could be a single slot or hole or a series of slots or holes depending upon the precise panel motion desired.

In operation, referring to the embodiment of FIGS. 2 and 3, the pressure switch is set to trip at a pressure corresponding to the depth at which drogue deployment is deisred. Projectile 11 is pulled downward to the maximum depth, which in this case is 1,000 ft, and then released from coupling 17. This release causes electrical contact with pulldown line 16 to be broken, resulting in the pressure switch circuit in projectile 11, not shown, becoming armed. The positively buoyant projectile accelerates toward the water surface until terminal ascent velocity is achieved and then continues upward at such velocity. When the pressure switch, which preferably senses the depth of the center of buoyancy indicated at 14, reaches the depth at which it is set to trip, the switch is actuated and completes a circuit between a battery in the projectile and solenoid 49, establishing a voltage across the solenoid which triggers the solenoid and effects release of catch 48. Upon catch 48 being released, the compression of leaf springs 31 provides a sufficient force to start panels 21 outward from the nested position a few degrees thereby permitting water to engage the panels and rotate them outward. Continued water flow produced by the motion of projectile 11 forces the panels to continue to open. The initial force developed by the water on the panels is low and, because of the kinematic arrangement of the links and the damping effect of piston 26, the damper force is also low, causing portion 56 of the curve in FIG. 4 to be substantially linear. As panels 21 move further outward they try to accelerate at an increasing rate, tending to increase the velocity of the damper piston because the change in connecting link angle increases the absolute velocity ratio of the piston to the panels. However, as the damper piston tries to force entrapped water through control orifice 42 at an increasing rate, the water pressure rises and the drag force on the damper piston face increases proportionally to the piston velocity thereby preventing the panels from opening too quickly. This control of panel deployment is vital to prevent excessively high inertial loading on sensitive components inside the projectile and to prevent the panels from ripping off when the panel stops are contacted. Use of a single common damper for all four panels insures uniform opening of the panels which prevents a turning moment from being imparted to the projectile due to unsymmetrical panel deployment. Once the deceleration device has performed its function and the decelerated projectile has been recovered, panels 21 may simply be pushed back to the closed condition and hooks 24 engaged in catch 48 to render the device ready for reuse.

There is thus provided a drogue deceleration device capable of decelerating a projectile rising at terminal ascent velocity within a selected distance such as 100 ft depending upon the size of orifice 42 and the panel configuration and operation. A single common damping means insures symmetrical panel opening so that no turning moment on the projectile is developed. The fluid release damping means controls the dynamics of panel opening more efficiently than other known drogue-type energy absorbing or dissipating means. The device occupies a minimum volume in the projectile, and deceleration of the projectile can be varied simply by adjusting the damping means orifice. By such adjusting the device can be made to open very rapidly, sustaining very high loading without structural failure. Damping is directly proportional to deceleration velocity force, the quantity being controlled. The kinematic energy of the panels is dissipated rather than being stored which would occur if springs were used as the sole means for cushioning panel impact. As noted above, the device is quickly reuseable by merely nesting the panels and engaging the hooks with the solenoid latch.

Obviously, many modifications and variations of the invention are possible in the light of the foregoing teachings.

What is claimed is:

1. A device for rapidly decelerating a high velocity projectile in a liquid medium comprising:
   - a plurality of decelerating panels pivotably connected to the aft end of said projectile;
   - means in said projectile for deploying said panels upon the occurrence of a selected pressure condition;
   - means in said projectile connected to said panels for damping the deployment of said panels; and
   - coupling means at the aft end of said projectile for bringing said projectile to a selected depth for release,
   - said panels conforming to the outer periphery of said projectile in the inoperative or nested condition.

2. The deceleration device as defined in claim 1 wherein said damping means include means resiliently urging the forward portions of said panels outward upon initial release thereof and means for controlling further opening after release so that said panels are initially moved outward into the fluid stream and thereafter accelerated by motion of said projectile until damped by the operation of said decelerating panels.

3. The deceleration device as defined in claim 2 wherein said means for damping the deployment of said panels includes a piston having a head end and a panel connecting end disposed in separate chambers in said projectile, said piston having a hollow shaft exposed to the fluid medium and an opening in said shaft adjacent said head end for providing a constricted passage for the release of fluid as said piston is actuated by said panels in response to movement of the projectile through the medium.

4. The deceleration device as defined in claim 3 wherein said means for releasing said panels include a releasing solenoid axially disposed in said projectile for releasing said panels, and said panels include connecting links coupling the panels to said piston connecting end and to tabs for engaging said releasing solenoid;

said panels in the inoperative condition secured against the projectile body; and means for energizing said solenoid at a selected depth thereby releasing said tabs and allowing said panels to deploy.

5. The deceleration device as defined in claim 4 wherein said projectile is cylindrical and said panels are 4 in number and cylindrically contoured to form a portion of the wall of said projectile when in the inoperative condition.

said projectile recessed where the forward ends of said panels are received and said panels oppositely recessed so as to form a continuous surface with the periphery of said projectile when the panels are in the inoperative or nested condition, said panels pivotally mounted on said projectile at the aft end thereof and said tabs disposed substantially intermediate the pivoted and recessed ends of said panels.

6. A deceleration device comprising:

a housing connected to a body whose motion is to be arrested within a specified distance of travel;

a plurality of deployable deceleration panels pivotably mounted on and forming a portion of said housing in the inoperative condition, damping means in said housing and rods connecting said damping means and respective panels, said panels pivoted adjacent the aft end of said housing and said rods pivotably connecting said damping means and substantially the midpoint of said panels to more evenly distribute reaction forces during deceleration;

means releasably holding said panels in nesting relationship to said housing during travel of said body in a fluid medium;

means continually exerting a force tending to open said panels upon release of said holding means; and means in said housing responsive to selected ambient conditions for releasing said holding means at the occurrence of said selected conditions so that upon occurrence of said conditions said panels are released and initially urged open by said means exerting a force thereagainst and thereafter are accelerated open by said medium and then damped to the fully open position by said damping means.

7. The deceleration device as defined in claim 6 wherein said means responsive to selected conditions include a pressure sensitive switch in said body and a solenoid actuated by said switch for selectively releasing said panels, said damping means including a piston and shaft and a piston chamber exposed to said medium and arranged so that movement of said piston in response to the opening of said panels forces a confined volume of fluid out of selective sized orifice means thereby creating a force retarding the opening of said panels.

8. The deceleration device as defined in claim 7 wherein said piston is disposed forward of said solenoid and said shaft is hollow and accommodates electrical connectors energizing said solenoid, said confined volume of fluid surrounding said shaft and released through an orifice in the wall of said shaft, said rods connected to the aft end of said piston shaft do as to act through said shaft in drawing said piston aft during deceleration, said releasable holding means including a catch operated by said solenoid and lugs on said panels releasably engaged by said catch.

9. The deceleration device as defined in claim 7 wherein said solenoid is positioned forward of said piston, said piston is hollow and has a reduced diameter cylindrical portion at its aft end, and said housing includes a collar extending in close fit into said cylindrical portion, said confined fluid contained between said collar and said cylindrical portion, said collar having an orifice adjacent its aft end through which said fluid is released during deceleration, said piston spring-loaded in said housing and having an internal flange at its forward end and said releasable holding means including a catch operated by said solenoid which releasably engages said flange, said rods connected to said piston intermediate said flange and said cylindrical portion of said piston.

10. The deceleration device as defined in claim 7 wherein said solenoid is positioned forward of said piston and said releasable holding means include a spring-loaded circumferential catch extending aft of the forward end of said panels when in the inoperative condition, said panels including internally extending tabs which are releasably engaged by said catch, said piston having a hollow shaft and said housing including a collar adapted to internally receive said shaft in close fit;

a spring disposed in said housing forward of said piston for continually urging said piston aft, said shaft exposed to the ambient medium and said collar having orifices for selectively releasing fluid in said shaft during deceleration, said rods connected to said piston adjacent its forward end; and a spring disposed in said shaft to provide additional damping of said panels on deceleration of said body.

* * * * *